US005957734A

United States Patent [19]

Gladd et al.

[11] Patent Number: 5,957,734

[45] Date of Patent: Sep. 28, 1999

[54] TUNING FORK INLINE CONNECTION SYSTEM

[75] Inventors: Joseph Howard Gladd, Cortland; Jeffrey Michael Hickox, Middlefield, both of Ohio

[73] Assignee: General Motors Corporation, Detrotit, Mich.

[21] Appl. No.: 09/010,273

[22] Filed: Jan. 21, 1998

[51] Int. Cl.[6] ..... H01R 11/22

[52] U.S. Cl. ..... 439/857; 439/885

[58] Field of Search ..... 439/856, 857, 439/885, 81

[56] References Cited

U.S. PATENT DOCUMENTS

| | | | |
|---|---|---|---|
| 4,968,270 | 11/1990 | Colleran et al. | 439/699.2 |
| 5,004,426 | 4/1991 | Barnett | 439/856 |
| 5,011,426 | 4/1991 | Colleran et al. | 439/357 |
| 5,049,095 | 9/1991 | Gugelmeyer | 439/856 |
| 5,201,663 | 4/1993 | Kikuchi et al. | 439/81 |
| 5,611,716 | 3/1997 | Egenolf | 439/857 |
| 5,613,885 | 3/1997 | Plate et al. | 439/856 |
| 5,618,187 | 4/1997 | Goto | 439/857 |

*Primary Examiner*—Steven L. Stephan
*Assistant Examiner*—Javaid Nasri
*Attorney, Agent, or Firm*—Cary W. Brooks; Patrick M. Griffin

[57] ABSTRACT

A tuning fork according to the present invention is made from a relatively thin blank of stamping stock. A plurality of tuning fork units are stamped out of the blank and carried on a continuous strip for further processing. The tuning fork units include integral first and second terminal portions with a first arm extending therebetween. The first terminal portion includes a first core body having first and second spaced apart contact beams extending from one end and a cable mounting portion extending from the other end of the first core body. Likewise, the second terminal portion includes a second core body and third and fourth spaced apart contact beams extending from one end, and preferably a tail extending from the other end of the second core body. The first arm is bent so that the second core body overlies the first core body and the contact beams of the second terminal portion overlie the contact beams of the first terminal portion. The four contact beams are positioned to provide a slot between the contact beams for receiving a portion of another terminal.

5 Claims, 6 Drawing Sheets

TUNING FORK INLINE CONNECTION SYSTEM

TECHNICAL FIELD

This invention relates to tuning fork electrical terminals.

BACKGROUND OF THE INVENTION

In electrical connector applications, metal terminals with male and female configurations are utilized to make an interconnection. The terminals are crimped to the core of an electrical cable and stabilized with less critical insulation crimp wings. The terminals usually have complicated blanking and forming operations and at least one of the two terminals has a spring member designed to provide a constant electrical contact. Both terminals have metal lock tangs (protrusions) to hold them in plastic housings of male and female connector halves. A similar protrusion is provided as a shoulder for a terminal position assurance that retains the terminals in the plastic housing. As such, the terminals usually have complicated configurations.

There are other numerous shortcomings of the above systems. The terminals are manufactured using numerous blanking and forming operations and have relatively large dies. The larger the die the more expensive the connectors are to a manufacturer. Different crimp wings for various gauge sizes requires additional assembly dies adding to the assembly costs. The transitional zone between the spring contact and the crimp wing of the terminal limits the amount of current that can flow through the connector interface. Further, standard crimps are subject to environmental degradation and stress relaxation. Crimps add resistance to current flow and can degrade over time. And as indicated above, due to their complicated design, many terminals utilize a substantial amount of blanking stock.

Increasing the blanking stock thickness to make a tuning fork for a high current applications is undesirable because the tuning fork will have crimp wings that are substantially thick and extremely difficult to crimp over the wire core and insulative sheath.

The present invention provides advantages over and alternatives to the prior art.

SUMMARY OF THE INVENTION

A tuning fork according to the present invention is made from a relatively thin blank of stamping stock. A plurality of tuning fork units are stamped out of the blank and carried on a continuous strip for further processing. The tuning fork units include integral first and second terminal portions with a first arm extending therebetween. The first terminal portion includes a first core body having first and second spaced apart contact beams extending from one end, and a cable mounting portion extending from the other end of the first core body. Likewise, the second terminal portion includes a second core body and third and fourth spaced apart contact beams extending from one end, and preferably a tail extending from the other end of the second core body. The first arm is bent so that the second core body overlies the first core body and the contact beams of the second terminal portion overlie the contact beams of the first terminal portion. The four contact beams are positioned to provide a slot between the contact beams for receiving a portion of another terminal.

In a preferred embodiment, the mounting portion of the first terminal portion includes wire core crimp tabs and a pair of insulation crimp wings extending outwardly from the first core body. Preferably, the first contact beam includes first and second spaced apart nubs extending towards the second contact beam. The first and second nubs are separated by a first valley formed along the edge of the first beam. The second contact beam includes a third nub extending towards the first beam and aligned with the first valley of the first beam. Further, the third contact beam includes third and fourth nubs extending towards the fourth contact beam and separated by a second valley formed along the edge of the third beam. The fourth contact beam includes a sixth nub extending towards the third contact beam and aligned with the second valley. The second terminal portion is folded over the first terminal portion so that the nubs provide sixth isolated electrical contact points. A second arm preferably extends from the opposite side of the first or second core body. The first and second arms thus provide locking shoulders for engaging locking features of a connector housing or noise piece. Preferably the first and second core bodies are sonic welded together immediately after the folding operation or when the wire core is sonic welded to the tuning fork.

These and other objects, features and advantages of the present invention will become apparent from the following brief description of the drawings, detailed description and appended claims and drawings.

DESCRIPTION OF THE PREFERRED EMBODIMENT

Figure 1:
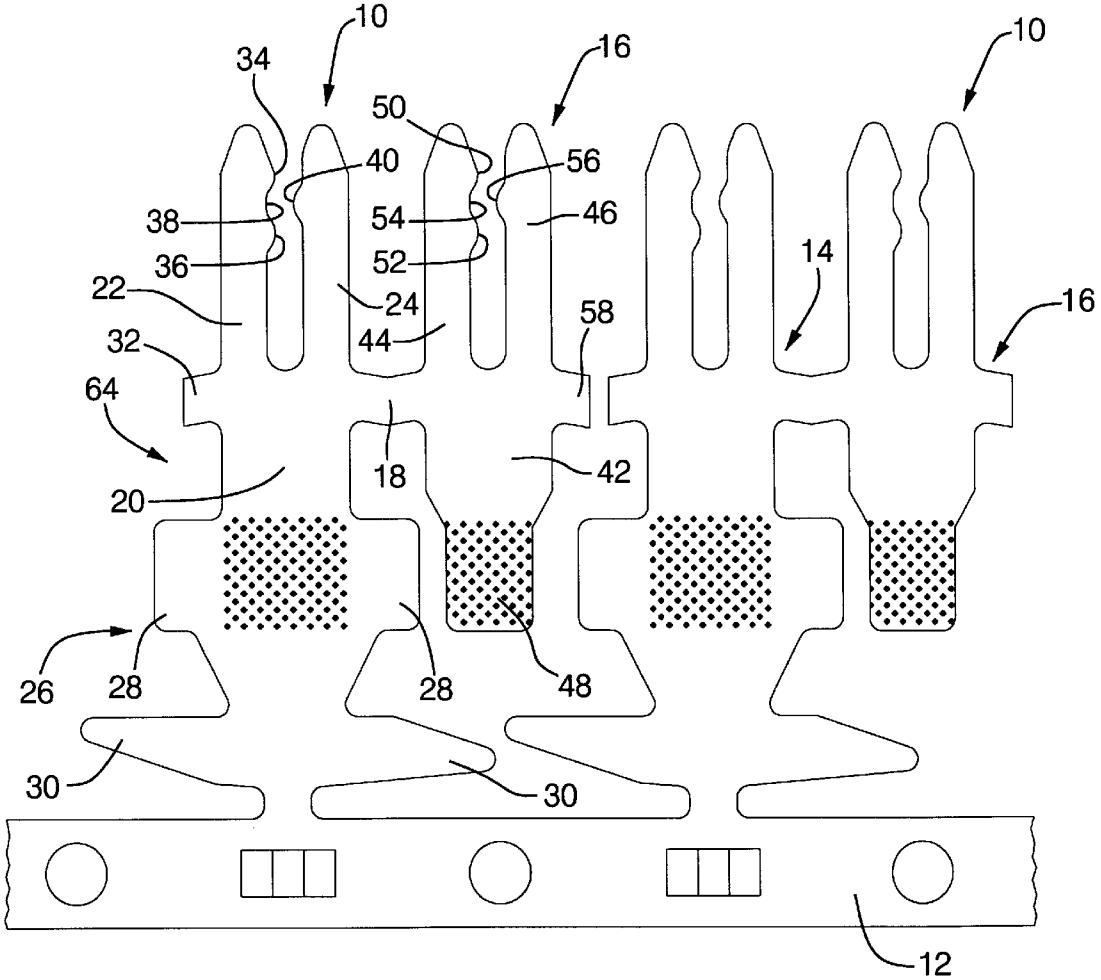
FIG. 1 illustrates a stamping utilized to make a tuning fork terminal according to the present invention.

FIG. 1 illustrates a stamping utilized to make a tuning fork according to the present invention. The stamping includes a plurality of tuning fork units 10 attached to a carrier strip 12. Each tuning fork unit includes integral first and second terminal portions 14, 16 and a first arm 18 extending therebetween. Each tuning fork unit 10 is a single piece integral continuous piece of metal formed from stock having a relatively narrow thickness of about 0.0012 to about 0.0020, and preferably 0.0016 inches. The first terminal portion 14 includes a first core body 20 and first and second spaced apart contact beams 22, 24 extending from one end of the first core body 20 and a mounting member 26 extending from the other end. Preferably the mounting member 26 includes a pair of wire crimp tabs 28 extending outwardly from opposite sides of the first core body 20. Likewise, a pair of insulation crimp wings 30 are positioned below the crimp tabs 28 with each wing 30 extending outwardly from an opposite side of the first core body 20. The first terminal portion may also include a second arm 32 extending outwardly from the first core body 20 on an opposite side from the first arm 18.

A first and second nub 34, 36 may be formed on an inside edge of the first contact beam 22 and spaced apart by a first valley 38. A third nub 40 may be provided on an inside edge of the second beam 24 extending towards the first beam 22 and positioned to align with the first valley 38.

The second terminal portion 16 includes a second core body 42 and a third and fourth contact beam 44, 46 extending from a first end of the second core body 42. Like the first terminal portion 14, the third beam 44 may have a fourth and fifth spaced apart nubs 50, 52 formed on an inside edge and separated by a second valley 54. The fourth beam 46 includes a sixth nub 56 formed on an inside edge thereof extending towards the third beam 44 and aligned with the second valley 54. A third arm 58 may extend outwardly from the second core body 42 and overlie the second arm 32 or may act as a substitute for the second arm 32. A tail 48 may extend from a second end of the core body 42.

Figure 2:
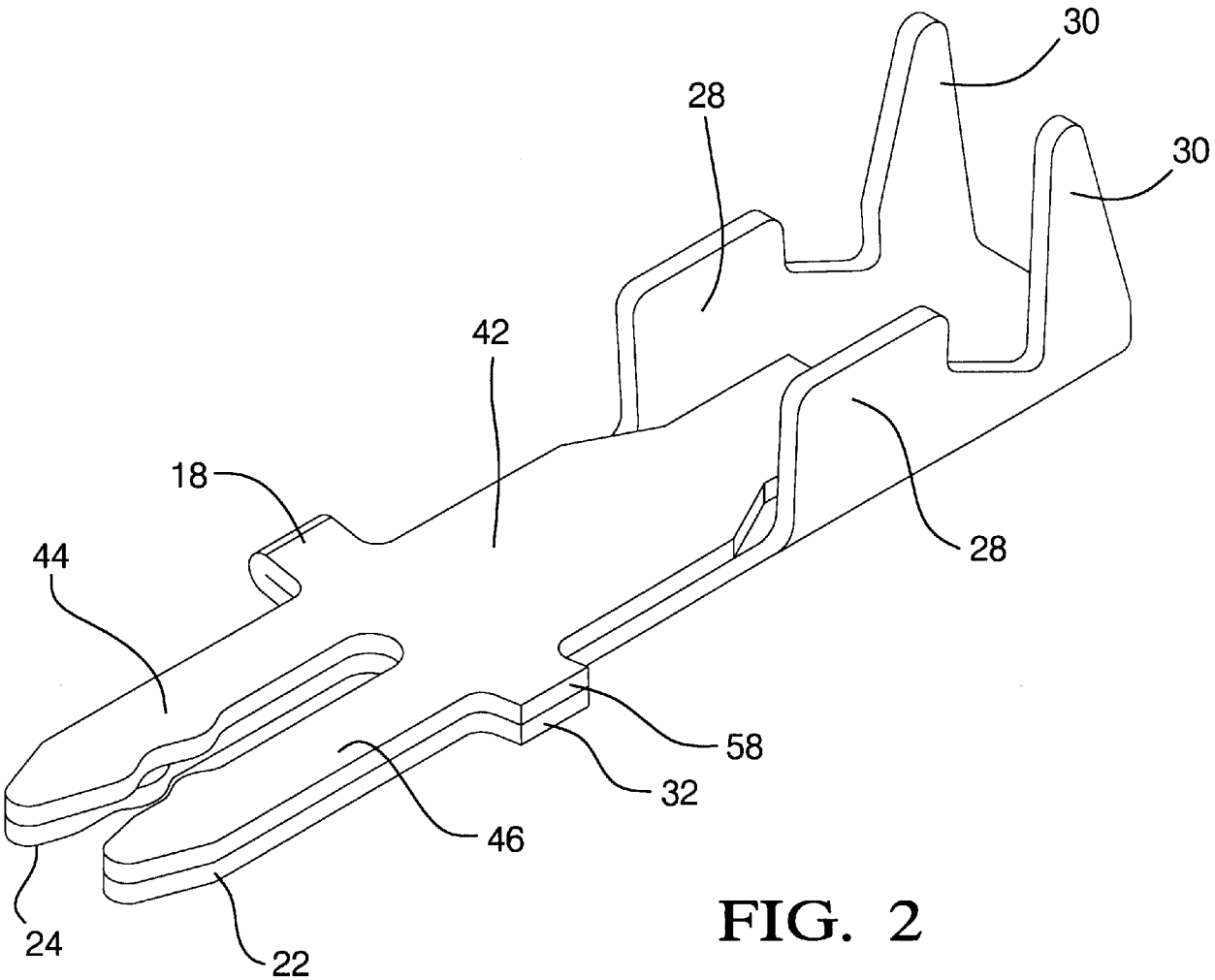
FIG. 2 a perspective view of a tuning fork terminal according to the present invention.
Figure 3:
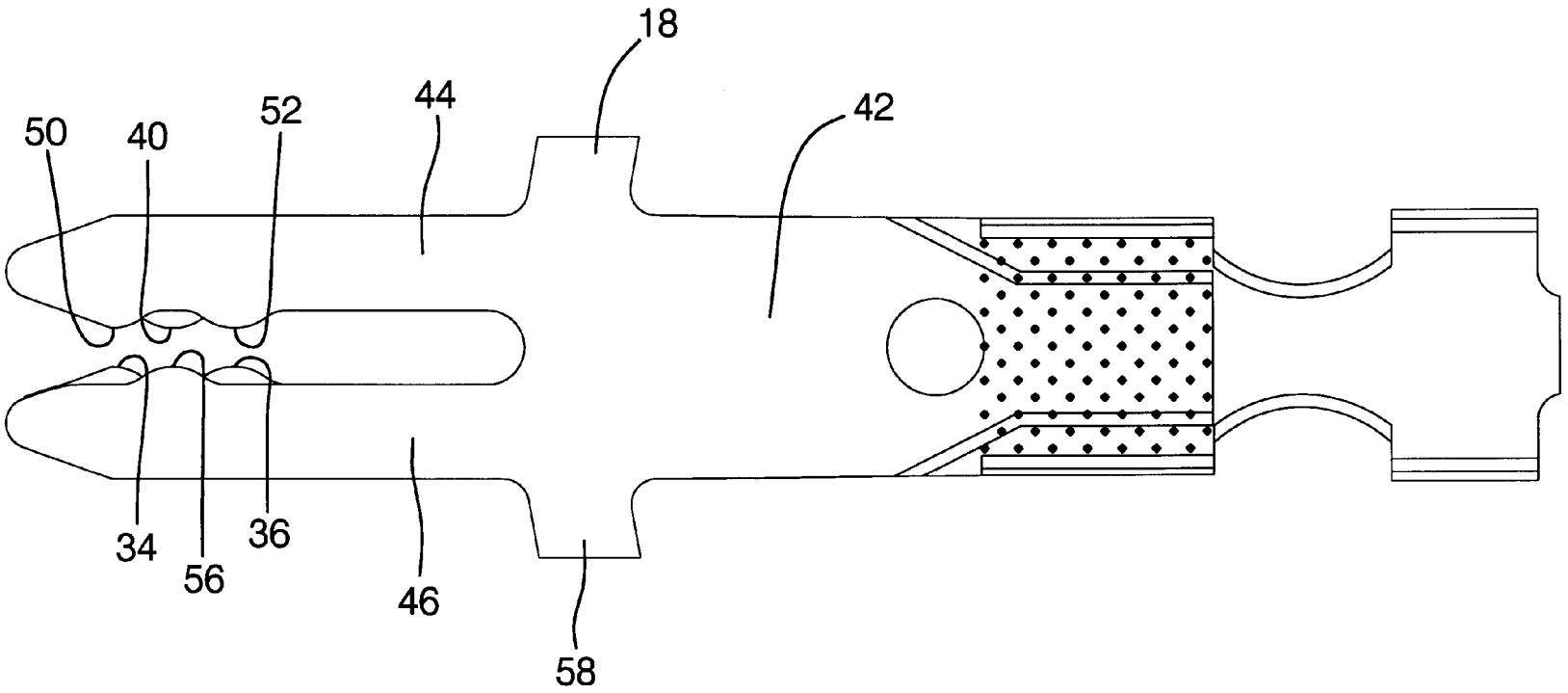
FIG. 3 is a top view of a tuning fork terminal according to the present invention showing six isolated electrical contacts.

Referring to FIGS. 1–3, to form the tuning fork according to the present invention, the tuning fork unit 10 is cut from the carrier strip 12 (FIG. 1) and the first arm 18 is bent so that the second core body 42 overlies the first core body 20. The fourth contact beam 46 overlies the first contact beam 22 so that the sixth nub 56 overlies the first valley 38 on the first beam and is positioned between the first nub 34 and the second nub 36. Likewise, the third contact beam 44 overlies the second contact beam 24 so that the third nub 40 is aligned with the second valley 54 on the third contact beam and is between the fourth and fifth nubs 50, 52. FIG. 3 is a top view of a tuning fork according to the present invention illustrating six isolated contact locations corresponding to the six nubs 34, 56, 36, 50, 40, 52.

The second core body 42 may be secured to the first core body 20 in a variety of methods, but preferably is sonic welded. The core bodies 20, 42 may be sonic welded together immediately after the folding operation or may be sonic welded when a wire core is placed over the second core body 42 and sonic welded to the same. The wire core is also positioned so that it may be sonic welded to the crimp tabs 28. Thereafter, the insulation crimp wings 30 are folded over the insulation portion of the cable.

Figure 4:
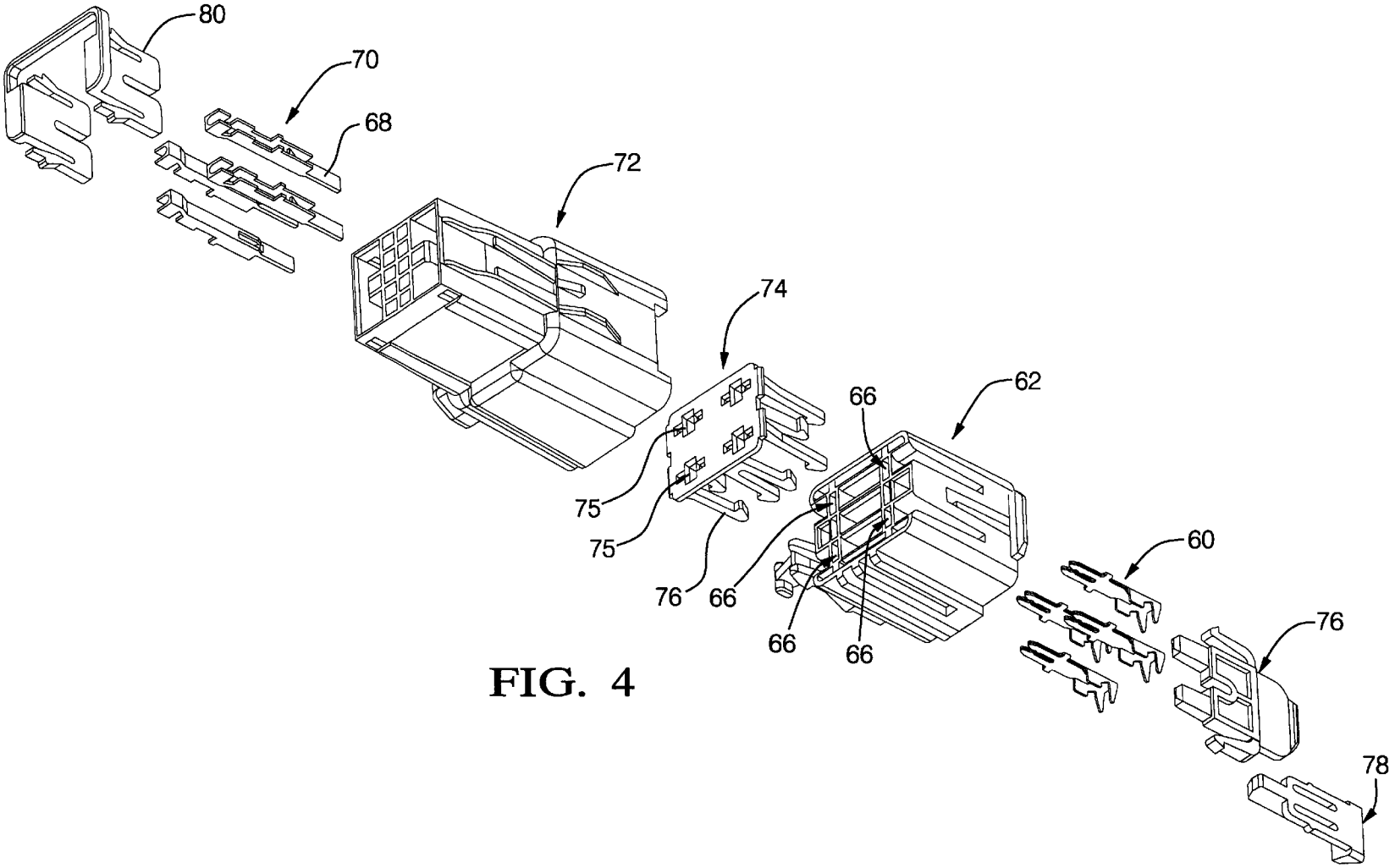
FIG. 4 is an exploded view of a connector system utilizing a tuning fork terminal according to the present invention.
Figure 5:
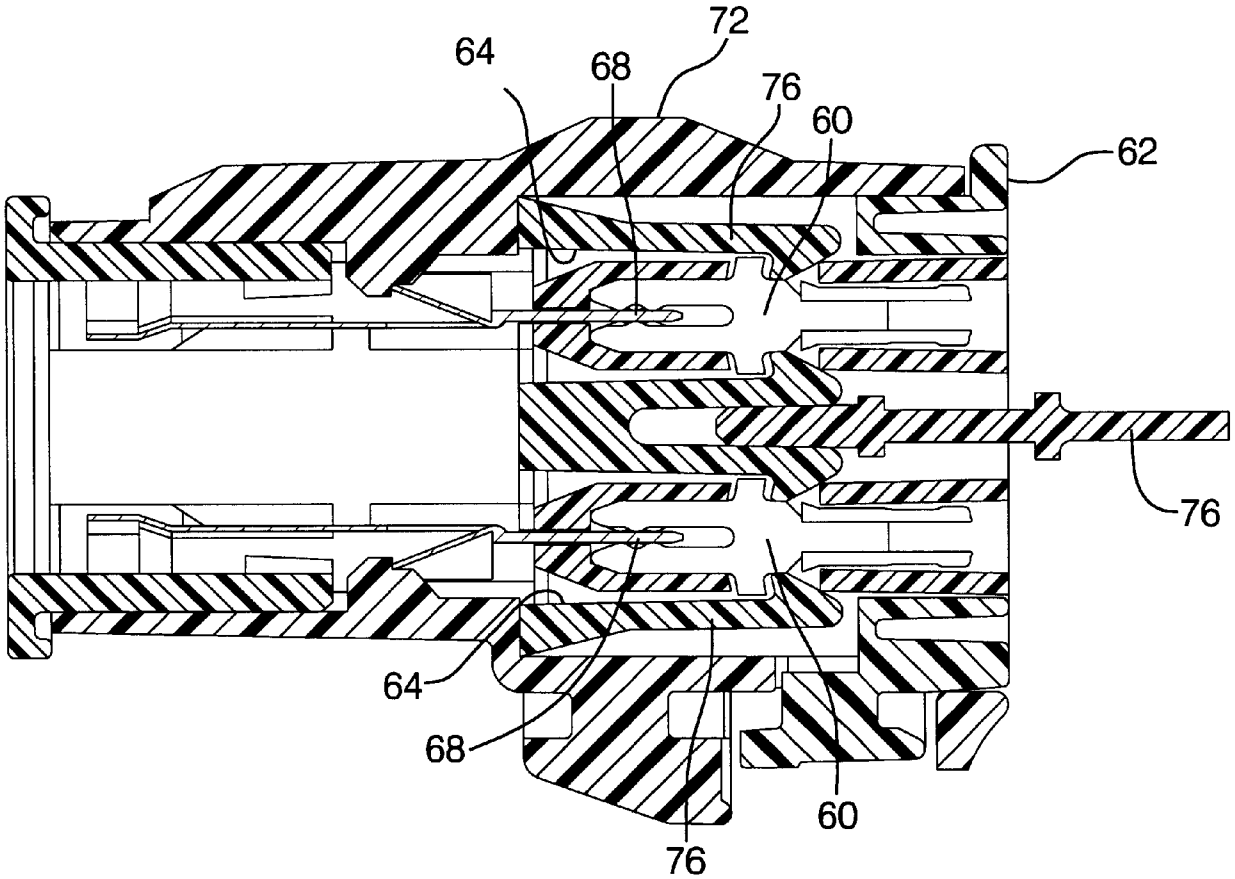
FIG. 5 is a sectional view of a connector having a tuning fork according to the present invention received therein.

The tuning fork according to the present invention may be utilized in a variety of applications. Referring to FIGS. 4–5, one such application includes a tuning fork 60 received in a connector housing 62 having a plurality of terminal cavities 64 (best seen in FIG. 5) and having an opening 66 at one end for receiving a blade 68 of a male terminal 70 carried in a male connector housing 72. A nose piece 74 may be attached to the tuning fork connector housing 62 and includes a plurality of lock fingers 76 extending into the connector housing for securing to the arms 18, 32, 58 of the tuning fork terminal 60 (FIG. 5). The noise piece 74 has openings 75 for inserting the blade 68 of the male terminal 70 (FIG. 4).

Referring again to FIG. 4, a terminal position assurance member 76 may be inserted into the tuning fork connector 62 to insure proper alignment of the tuning forks. A connector position assurance member 78 may be provided to insure proper alignment and connection of the connector bodies 62 and 72. Likewise, a male terminal position assurance member 80 may be received in the connector 72 for the male terminal 70 to insure proper alignment of the same.

Figure 6:
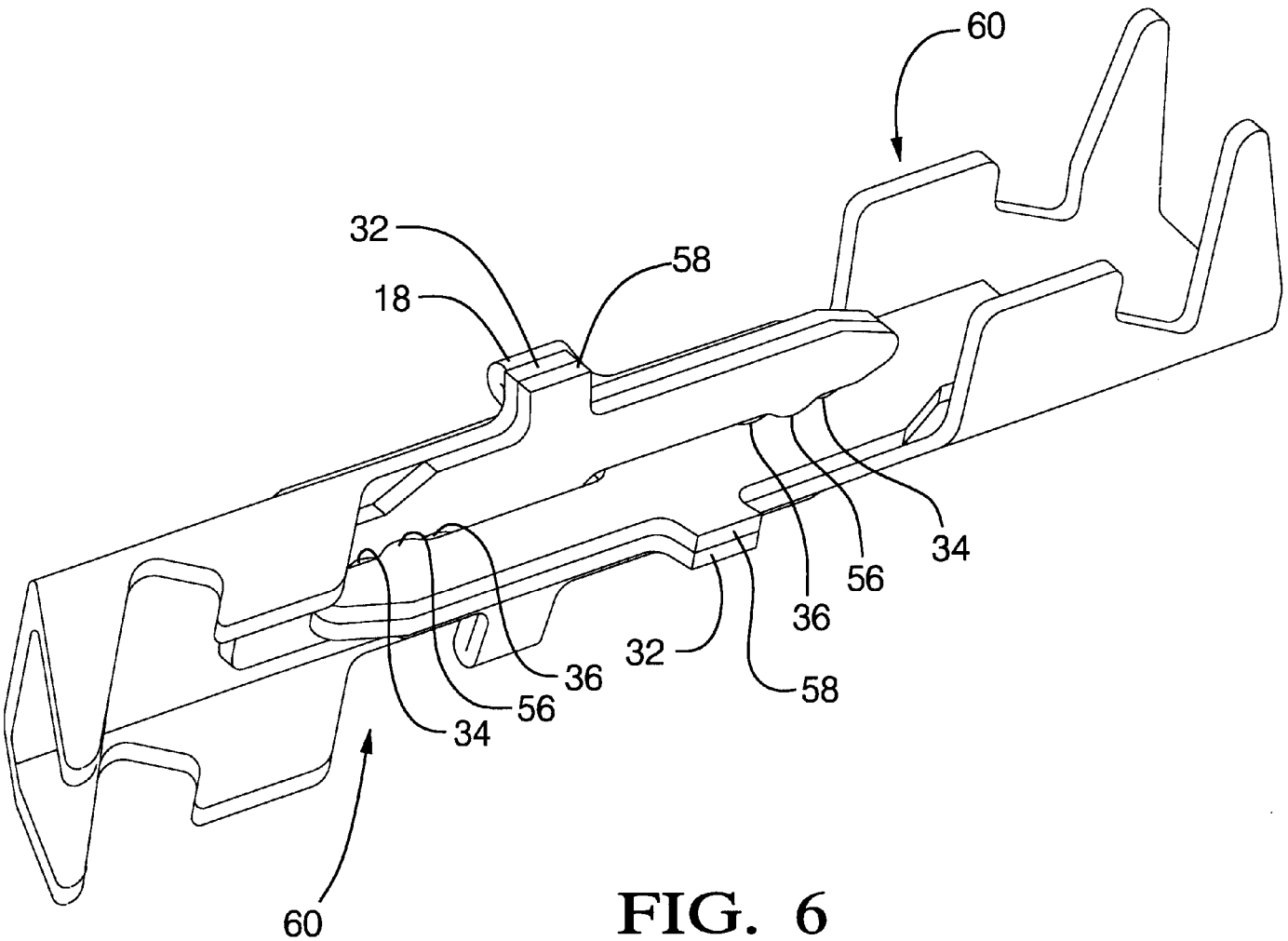
FIG. 6 illustrates two tuning fork terminals according to the present invention interconnected to provide twelve isolated electrical contacts.

FIG. 6 illustrates a system utilizing two tuning forks 60 according to the present invention in that each tuning fork has six defined contact points, the use of a female/female connection concept provides twelve contact interfaces associated with twelve separate nubs, eight flexible contact beams, minimal bulk resistance in a very short profile.

We claim:

1. A product including:

a tuning fork electrical terminal including a first core body and a first and a second contact beam spaced from each other and each extending from one end of the first core body, a second core body and a third and a fourth contact beam spaced from each other and each extending from one end of the second core body, and including a first arm extending between the first core body and the second core body and the first arm being bent so that the first core body overlies the second core body and the first core body and the second core body being secured together so that the fourth contact beam overlies the first contact beam and so that the third contact beam overlies the second contact beam, and a slot for receiving a portion of another terminal being provided between the first and the second contact beam and between the third and the fourth contact beam, and including a mounting member having insulation crimp, wines, and wherein the tuning fork electrical terminal is formed from a single piece of continuous metal.

2. A product as set forth in claim 1 further comprising a first and a second nub spaced apart from each other and each formed on an inside edge of the first contact beam and spaced apart by a first valley, and a third nub provided on an inside edge of the second beam extending toward the first beam and positioned to align with the first valley, and a forth and a fifth nub spaced apart from each other and each formed on an inside edge of the third beam and separated by a second valley, and a sixth nub formed on an inside edge of the fourth beam and extending toward the third beam and aligned with the second valley so that the tuning fork provides six isolated contact locations associated with the first, second, third, fourth, fifth and sixth nubs.

3. The product as set forth in claim 1 further comprising a connector housing carrying the tuning fork electrical terminal.

4. The product as set forth in claim 3 further including a second arm extending from one of the core bodies for securing the terminal in the housing.

5. The product as set forth in claim 4 further including a nose piece secured to the housing and including holes for receiving a portion of another terminal and including flexible lock fingers for locking against one of the associated arms.

* * * * *